US010801153B2

(12) United States Patent
Choi

(10) Patent No.: US 10,801,153 B2
(45) Date of Patent: Oct. 13, 2020

(54) APPARATUS FOR TREATING LAUNDRY

(71) Applicant: LG Electronics Inc., Seoul (KR)

(72) Inventor: Wooje Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 292 days.

(21) Appl. No.: 15/907,545

(22) Filed: Feb. 28, 2018

(65) Prior Publication Data

US 2018/0245260 A1 Aug. 30, 2018

(30) Foreign Application Priority Data

Feb. 28, 2017 (KR) ..... 10-2017-0026798

(51) Int. Cl.
*D06F 37/24* (2006.01)
*D06F 37/26* (2006.01)
*D06F 39/12* (2006.01)

(52) U.S. Cl.
CPC ..... *D06F 37/24* (2013.01); *D06F 37/264* (2013.01); *D06F 39/12* (2013.01)

(58) Field of Classification Search
CPC ..... D06F 37/24; D06F 37/264; D06F 39/12
USPC ..... 68/212
See application file for complete search history.

(56) References Cited

U.S. PATENT DOCUMENTS 5,685,623 A * 11/1997 Katz ..... D06F 39/12 312/263
2011/0248611 A1 10/2011 Hunnell et al.
2015/0130338 A1 5/2015 Lee et al.

FOREIGN PATENT DOCUMENTS

CN 203782436 U 8/2014
EP 2397599 12/2011

OTHER PUBLICATIONS

Search Report in European Application No. 18159311.2, dated Aug. 3, 2018, 10 pages.

* cited by examiner

*Primary Examiner* — Michael E Barr
*Assistant Examiner* — Tinsae B Ayalew
(74) *Attorney, Agent, or Firm* — Fish & Richardson P.C.

(57) ABSTRACT

Provided is an apparatus for treating laundry according to the present invention, including: a front cover that forms a front surface and includes a backward bent portion; a pair of side covers that form both flank surfaces, respectively, and that include sideward bent portions, respectively; a back cover that forms a rear-side surface; an outer tank that is positioned inside and holds water; an inner tank that is positioned rotatably inside the outer tank and holds foam; a motor that rotates the inner tank; a front member that is connected to the backward bent portion and extends along the backward bent portion; a pair of lateral members that extend along the pair of sideward bent portions, respectively; and a top cover that is connected to upper ends of the front cover, of the pair of side covers, and of the back cover, and has an insertion hole for the foam.

17 Claims, 12 Drawing Sheets

APPARATUS FOR TREATING LAUNDRY

CROSS-REFERENCE TO RELATED APPLICATION

This application claims the priority benefit of Korean Patent Application No. 10-2017-0026798, filed on Feb. 28, 2017, in the Korean Intellectual Property Office, the disclosure of which is incorporated herein by reference.

BACKGROUND

1. Field

The present invention relates to an apparatus for treating laundry, in which vibration occurs.

2. Description of the Related Art

An apparatus for treating laundry includes a casing that forms an external appearance, an outer tank that is positioned inside the casing and that holds water, an inner tank that is positioned rotatably inside the outer tank, and a pulsator that is positioned on a lower surface of the internal tank. The apparatus for treating laundry includes a motor that rotates the inner and/or the pulsator. The inner tank and/or the pulsator are rotated in a state where foam is contained in the inner tank, and thus a process, such as cleaning, rinsing, or dehydration is performed.

Apparatuses for treating laundry are categorized into two types. One type is an apparatus for treating laundry, in which an insertion opening for foam is formed in an upward position, and the other type is an apparatus for treating laundry, in which the insertion opening is formed in a forward position.

Rotation of the motor causes the inner tank and/or the pulsator to be rotated, and vibration that occurs due to this rotation moves to the casing. Particularly, in a situation where foam is contained in the inner tank, unbalance is caused by foam twist or foam deviation when the inner tank or the pulsator is rotated. In this case, a large vibration occurs in the casing.

In the related art, when the motor operates, a large vibration occurs to the casing depending on an amount of foam or the degree of foam deviation. Thus, there is a problem in that the shape of the casing is deformed beyond the elasticity limit or the casing is damaged. A first object of the present invention is to solve this problem.

In the related art, when the motor operates, the casing easily reaches the level of excessive vibration. Thus, there is a problem in that excessive noise and vibration occur. A second object of the present invention is to solve this problem.

In the related art, when, in some cases, with a suspension (hanger) structure, the weight of the outer tank is applied to an upper-side portion of the casing. Thus, there is a problem in that, particularly excessive deformation or damage occurs in an upper end portion of the case. A third object of the present invention is to solve this problem.

In a top-loading apparatus for treating laundry in the related art, there is a problem in that when excessive vibration of the casing occurs, a connection between a cabinet that forms front, left, and right surfaces, and a top cover that forms an upper-side surface is released. A fourth object of the present invention is to strengthen the connectivity between the cabinet and the top cover.

A fifth object of the present invention is to easily connect between the cabinet and the top cover or to release the connection between the cabinet and the top cover during a manufacturing process and a repair service process, as well as to achieve the objects described above.

No limitation to the objects described above is imposed, and from the following description, other objects of the present invention are apparent to a person of ordinary skill in the art.

SUMMARY

According to the present invention, as constituent elements for achieving the first to third objects, there are provided a front member and/or a rear member.

According to the present invention, a front member and a lateral member, as constituent elements for achieving the third object, are arranged on an upper end portion of a front cover, and on an upper end portion of a side cover, respectively.

According to the present invention, a gap formation unit and further a sub-member, as constituent elements for achieving the fourth and fifth objects, are provided.

According to an aspect of the present invention, there is provided an apparatus for treating laundry, including: a front cover that forms a front surface and that includes a backward bent portion that results from bending the front surface in such a manner that an upper end portion of the front surface extends in a backward direction; a pair of side covers that form both flank surfaces, respectively, a back cover that forms a rear-side surface; an outer tank that is positioned inside and that holds water; an inner tank that is positioned rotatably inside the outer tank and that holds foam; a motor that rotates the inner tank; a front member that is connected to the backward bent portion and that extends in a leftward-rightward direction along the backward bent portion; and a top cover that is connected to an upper end of the front cover, upper ends of the pair of side covers and an upper end of the back cover, and that has an insertion hole for the foam.

In the apparatus for treating laundry, the front member may include a gap formation portion that is positioned by a distance upward from an upper-side surface of the backward bent portion and thus forms a gap. In the apparatus for treating laundry, the top cover may include a backward protrusion portion that protrudes backward from a front lower end of the top cover and is inserted into the gap.

In the apparatus for treating laundry, the front member may further include a fixation portion that is connected to the upper-side surface of the backward bent portion.

The apparatus for treating laundry may further include a sub-member that is fixed to the front member and that includes a surface which is positioned on the upper side of the fixation portion. In the apparatus for treating laundry, the top cover may include a sub-protrusion-portion that protrudes backward from the front lower end of the top cover, and is inserted between the fixation portion and the sub-member.

In the apparatus for treating laundry, the front member may include an upper surface portion on which the gap formation portion is positioned, and a rear surface portion that extends downward from a rear end of the upper surface portion and that has a through-hole through which the backward protrusion portion passes.

In the apparatus for treating laundry, the front member may include an upper surface portion that is fixed to the upper side of the backward bent portion, a rear surface portion that extends downward from a rear end of the upper surface portion, and a lower surface portion that extends forward from a lower end of the rear surface portion.

In the apparatus for treating laundry, a front end of the lower surface portion may be brought into contact with an inside surface of the front cover.

The apparatus for treating laundry may further include a hanger that is fixed to upper-side both-end portions of the front cover; and a tension member of which one end is connected to the hanger and of which the other end is connected to the outer tank, and thus causes the outer tank to hang. In the apparatus for treating laundry, the front member includes a pair of hanger connection portions that are arranged on both end portions of the front member, respectively, and are connected to the hanger.

In the apparatus for treating laundry, the hanger may include a support plate that forms a horizontal plane. In the apparatus for treating laundry, the front member may include an upper surface portion that is fixed to the upper side of the backward bent portion, a rear surface portion that extends downward from a rear end of the upper surface portion, and a lower surface portion that extends forward from a lower end of the rear surface portion. In the apparatus for treating laundry, the hanger connection unit may include an extension portion that extends sideways from the lower surface portion, and a hanger hook portion that is positioned on the endmost portion of the extension unit and is hooked to the support plate.

In the apparatus for treating laundry, the side cover in a first direction may include a sideward bent portion that results from bending the side cover in the first direction in such a manner that an upper portion of the side cover in the first direction extends in a second direction that is opposite to the first direction. The apparatus for treating laundry may further include a lateral member that extends in a forward-backward direction along the sideward bent portion. In the apparatus for treating laundry, the lateral member may include a first part that is brought into contact with an inside surface in the second direction, of the side cover and a second part that is brought into contact with a lower-side surface of the sideward bent portion.

In the apparatus for treating laundry, the side cover in the first direction may further include includes a downward bent portion that extends downward from the second-direction endmost portion of the sideward bent portion. In the apparatus for treating laundry, the lateral member may include a third part that extends sideways from the second part and that is brought into contact with an inside surface in the first direction, of the downward bent portion.

The apparatus for treating laundry may further include a holder that is fixed to at least one of the sideward bent portion and the second part and that protrudes upward and thus the top cover is caused to be hooked to the holder.

In the apparatus for treating laundry, the front cover and the pair of side covers may be formed as a result of bending one plate.

The apparatus for treating laundry may further include a pair of side covers that form both flank surfaces, respectively, and that include sideward bent portions, respectively, each of which results from bending the each side cover in a direction in which upper end portions of the both flank surfaces face each other; and a pair of lateral members that extend in a forward-backward direction along the pair of sideward bent portions, respectively.

The front member or the lateral member increases the strength of a casing. This has the effect of preventing vibration from deforming and damaging the casing and of preventing the casing from reaching the level of excessive vibration.

In addition, the front member is positioned along an upper end portion of the front cover, or the lateral member is positioned along an upper end portion of the side cover. This has the effect of not only preventing an upper end portion of the casing to be deformed and damaged, but also preventing a connection between a cabinet and the top cover from being released.

In addition, a backward protrusion portion of the top cover is inserted into the gap. This has the effect of strengthening the connectivity between the cover and the front cover and making an assembly or disassembly process easier.

In addition, the hanger connection portion is used. This has the effect of reducing vibration that moves to the casing through a hanger.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
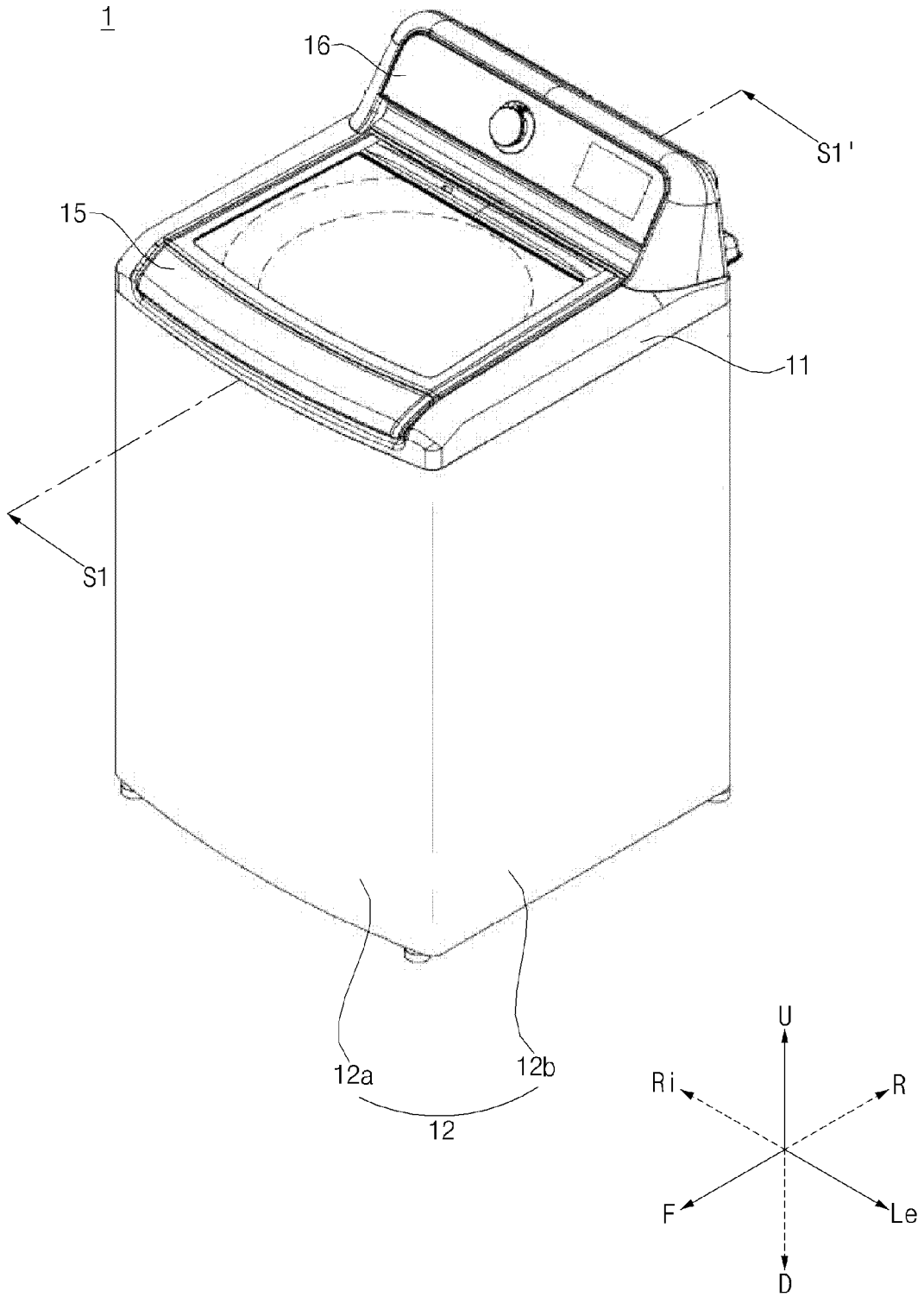
FIG. 1 is a perspective diagram illustrating an apparatus for treating laundry according to an embodiment of the present invention.

Definitions of adverbs relating to directions, such as forward (F), backward (B), leftward (L), rightward (R), upward (U) and downward (D) are defined as illustrated as FIG. 1, but these definitions serve only the purpose of definitely describing the present invention for easy understanding. Of course, the definitions of the directions may vary according to where cardinal points are marked.

A "first direction" that will be used below refers to one of the leftward direction and the rightward direction, and a "second direction" refers to the other.

The term that consists of a name of a constituent element and a modifier, such as a "first," "second," or a "third," which is placed before the name of the constituent element, is used only to avoid confusion between the constituent elements that are referred to. Therefore, the term has no relation to the order of the constituent elements, the degree of importance placed on each of the constituent elements, and a dominant-subordinate relationship among the constituent elements. For example, it is also possible that the invention that includes only a second constituent element without a first constituent element is implemented.

An apparatus for treating laundry, according to the present invention, may be a washing machine, a drying machine, a dehydrating machine, or the like. According to an embodiment of the present invention, the washing machine, as an example of the apparatus for treating laundry, will be described below with reference to FIGS. 1 to 3.

Figure 2:
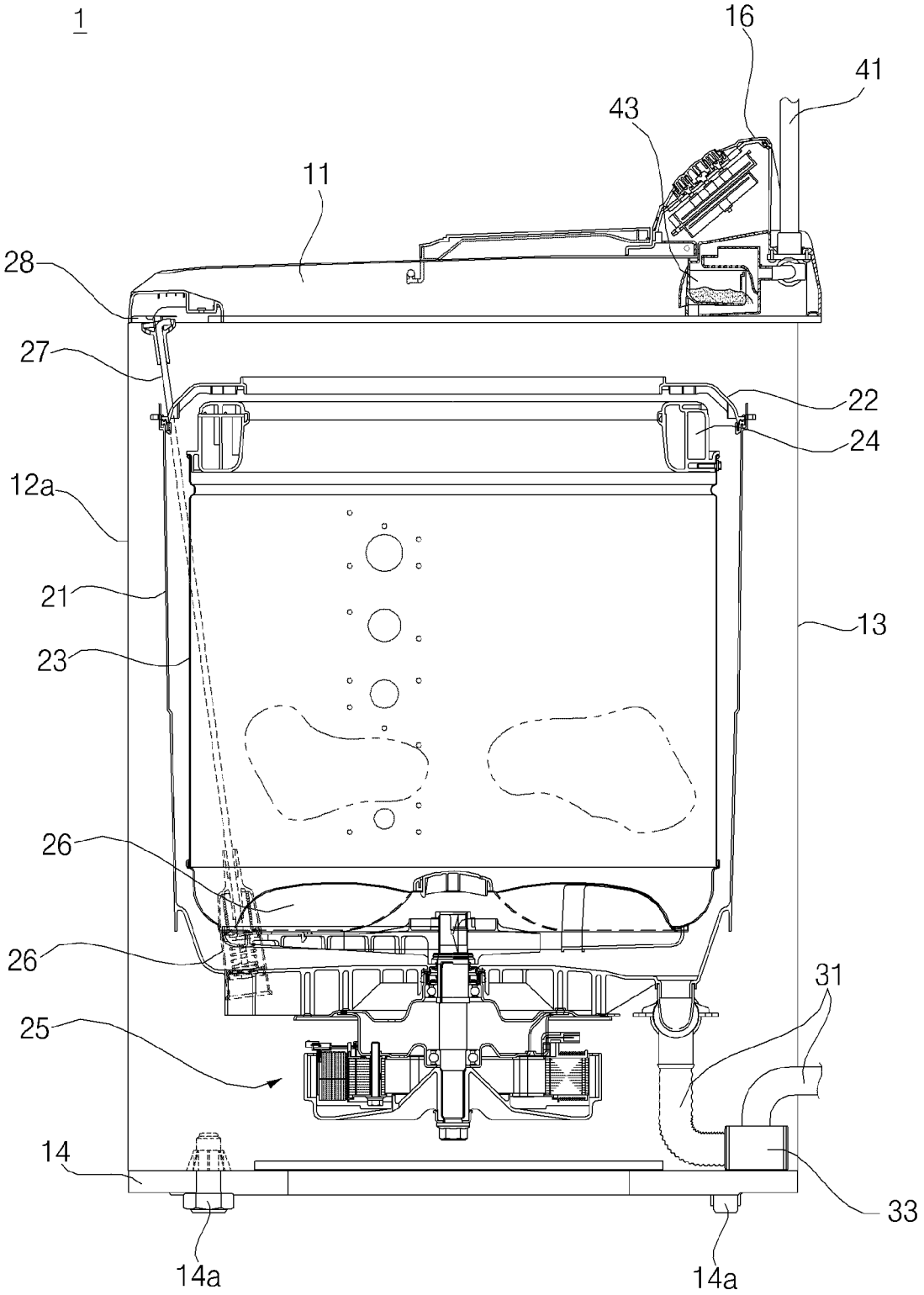
FIG. 2 is a vertical cross-sectional diagram illustrating the apparatus for treating laundry, taken along line S1-S1' on FIG. 1.

With reference to FIGS. 1 and 2, the apparatus 1 for treating laundry, according to the embodiment of the present invention, includes a casing 10 that forms an external appearance, an outer tank 21 that is positioned inside the casing 10, and an inner tank 23 that is positioned rotatably inside the outer tank 21. The apparatus 1 for treating laundry includes a pulsator 26 that is positioned rotatably on the bottom of the inner tank 23. The apparatus 1 for treating laundry includes a draining assembly (31 or 33) that causes water to run out of the outer tank 21 and a water-supplying assembly (41 or 43) that supplies water into the outer tank 21.

The casing 10 includes a cabinet 12 that forms a front surface and both flank surfaces thereof. The cabinet 12, which results from bending one plate to the shape of the Korean alphabet "ㄷ", forms the front surface and the both flank surfaces thereof. The cabinet 12 includes a front cover 12*a* that forms a front surface 12*a* thereof. The cabinet 12 includes a pair of side covers 12*b* that form the both flank surfaces, respectively, thereof. The front cover 12*a* and the pair of side covers 12*b* are formed as a result for bending one plate. The casing 10 includes a back cover 13 that has a rear-side surface. The cabinet 12 includes back cover connection units 12*d* that results from bending the side covers 12*b* in a pair in such a manner that rear ends of the side covers 12*b* in a pair face each other. The back cover connection unit 12*d* is fastened to the back cover 13.

The casing 10 includes a base 14 that forms a lower-side surface thereof. The base 14 is connected to a lower end of the cabinet 12. The base 14 is connected to a lower end of the back cover 13. The base 14 is connected to a lower end of the front cover 12*a* and lower ends of the side covers 12*b* in a pair. The base 14 includes a leg assembly 14*a* that is brought into contact with the ground and supports a weight of the apparatus 1 for treating laundry.

The casing 10 includes a top cover 11 that forms an upper-side surface thereof. The cover 11 is connected to an upper end of the cabinet 12. The cover 11 is connected to an upper end of the back cover 13. The cover 11 is connected to an upper end of the front cover 12 and upper ends of the side covers 12*b* in a pair. The cover 11 has an insertion opening for foam. Foam is drawn into and removed from the inner tank 23 through the insertion hole.

The apparatus 1 for treating laundry includes a door 15 that causes the insertion hole to be open and closed. The door 15 is connected rotatably to the top cover 11. The connecting of a front end portion of the door 15 to the top cover 11 closes the insertion opening, and the upward lifting of the front end portion of the door 15 causes the insertion hole to be open.

The apparatus 1 for treating laundry includes a control panel 16 into which user's various instructions are input. The control panel 16 includes an input unit (not illustrated), such as a button, a dial, a touch screen, or a combination of these. The control panel 16 includes an output unit (not illustrated), such as a display unit, that outputs various pieces of information.

The outer tank 21 holds water. An outer-tank cover 22 is connected to an upper end of the outer tank 22, and an opening portion is formed in the center portion of the outer tank 22. Foam is drawn into and removed from the inner tank 23 through the opening portion in the outer cover 22.

The inner tank 23 holds foam. The inner tank 23 is formed to have the shape of a cylinder, and an upper portion has an opening on top. A balancer 24 is connected to an upper end portion of the inner tank 23. The apparatus 1 for treating laundry includes a dehydration shaft (not illustrated) that is rotated by a motor 25, and the inner tank 23 rotates by the dehydration shaft.

The pulsator 26 is formed to protrude upward from a bottom surface of the inner tank 23. The apparatus 1 for treating laundry includes a laundry shaft (not illustrated) that is rotated by the motor 25, and the pulsator 26 is rotated by the laundry shaft. The laundry shaft and the dehydration shaft provide the same rotation axis.

The apparatus 1 for treating laundry includes the motor 25 that rotates the inner tank 23. The motor 25 rotates the pulsator 26. The motor 25 is positioned under the outer tank 21. The motor 25 is fixed by a support member (not illustrated) to the outer tank 21.

The apparatus 1 for treating laundry includes a tension member 27 that supports the outer tank 21. One end of the tension member 27 is connected to a hanger 28, and the other end of the tension member 27 is connected to the outer tank 21. The tension member 27 causes the outer tank 21 to hang from the casing 10. Multiple tension members 27 are arranged at distances from each other along an outer surface of the outer tank 21. The multiple tension members 27 are fixed to four corners, respectively, of an upper portion of the casing 10.

Figure 3:
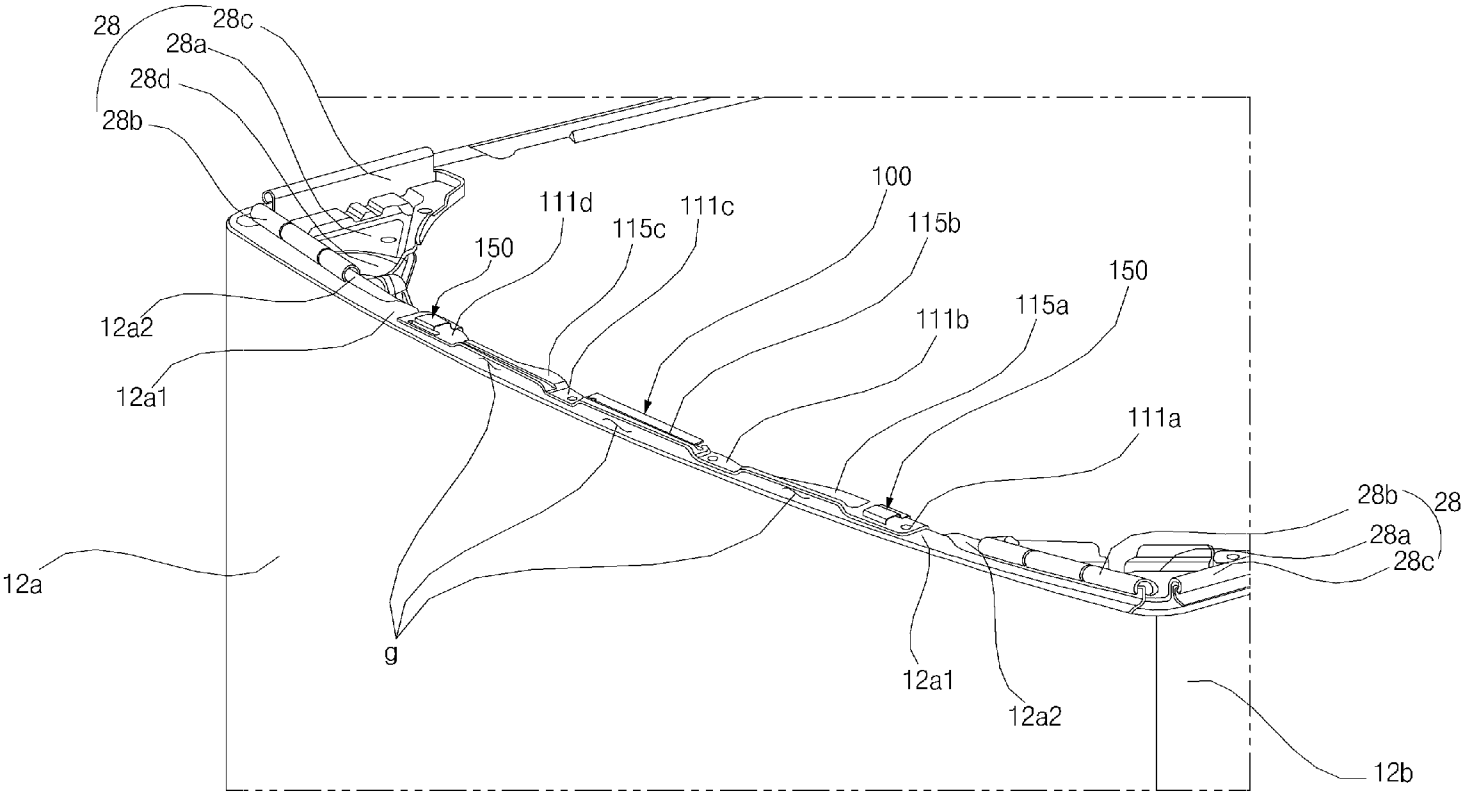
FIG. 3 is a perspective diagram illustrating a front upper-side portion of a cabinet and a front member that is connected to the front upper-side portion.
Figure 4:
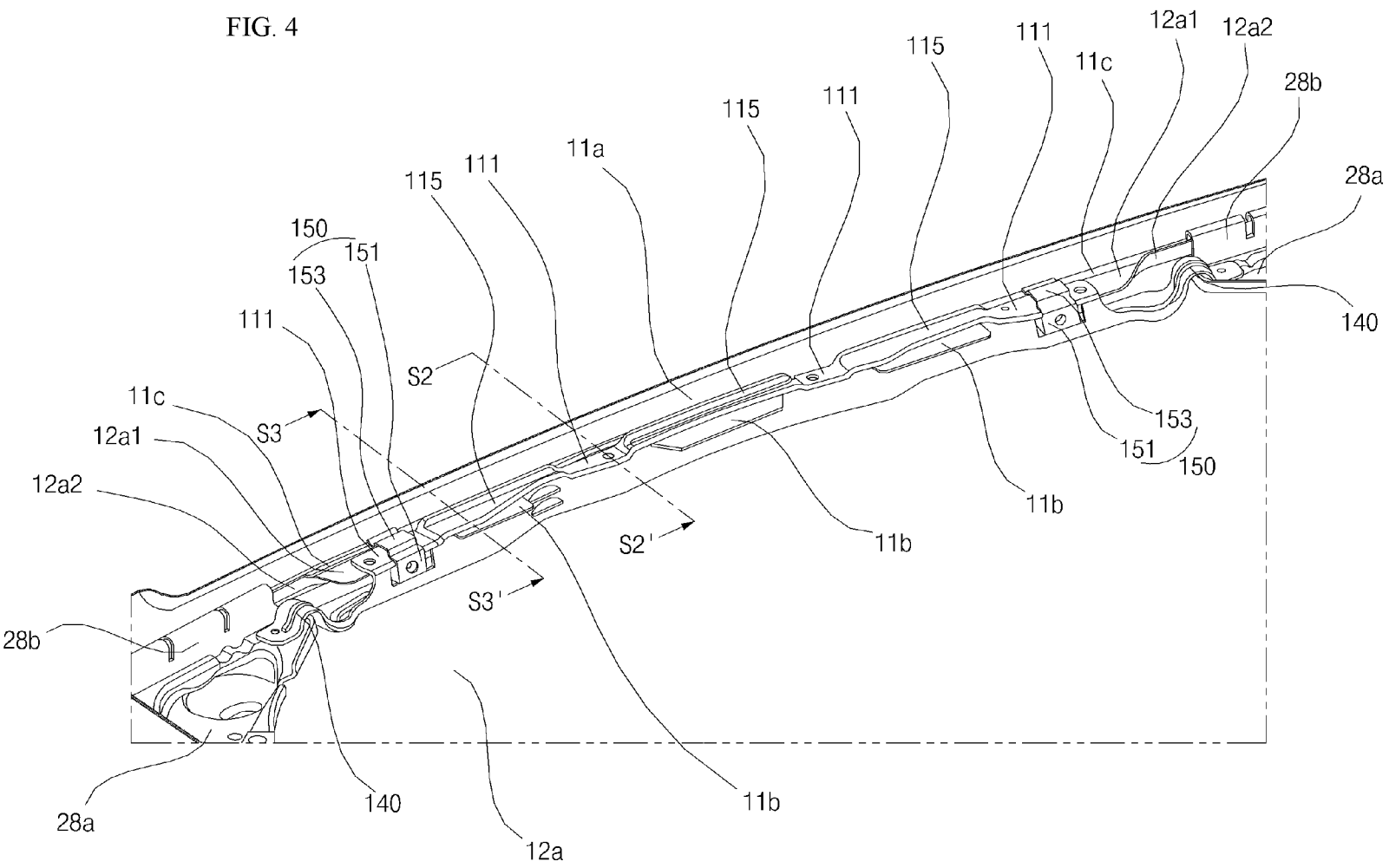
FIG. 4 is a horizontal cross-sectional diagram illustrating the front upper-side portion of the cabinet and the front member that is connected to the front upper-side portion, taken across a top cover connected to the cabinet.

With reference to FIGS. 3 and 4, the apparatus 1 for treating laundry includes the hanger 28 that supports the tension member 27. The hanger 28 is fixed to any one of the four corners of the upper portion of the casing 10. The hanger 28 is fixed to upper-side both-end portions of the front cover 12*a*. The hanger 28 is fixed to upper-side both-end portions of the back cover 13. Multiple hangers 28 are fixed to the four corners, respectively, of the upper portion of the casing 10.

The hanger 28 includes support plates 28*a*, each of which forms a horizontal plane. The front support plate 28 is positioned at a corner that the front cover 12*a* and the side cover 12*b* make with respect to each other. The rear support plate 28*a* is positioned at a corner that the side cover 12*b* and the back cover connection unit 12*d* make with respect to each other. The hanger 28 includes a pivot unit 28*d* to which one end of the tension member 27 is connected. The pivot unit 28*d* is provided in a manner that is rotatable about one end of the tension member 27. The pivot unit 28*d* is positioned on the center portion of the support plate 28*a*.

As a reference, the hanger 28 that has the front support plate will be described below. The hanger 28 includes a front hook portion 28*b* that is connected to the front cover 12*a*. For formation, a groove is recessed upward from the bottom of the front hook portion 28*b*. An upward bent portion 12*a*2 of the front cover 12*a* is inserted into the groove in the front hook portion 28*b*. The upward bent portion 12*a*2 supports the hanger 28. The hanger 28 includes a lateral hook portion 28*c* that is connected to the side cover 12*b*. For formation, a groove is recessed upward from the bottom of the lateral hook portion 28*c*. An upward bent portion 12*b*2 of the side cover 12*b* is inserted into the groove in the lateral hook portion 28*c*. The lateral hook portion 28*c* supports the hanger 28.

With reference again to FIG. 2, the draining assembly includes a draining pipe 31 that guides water within the outer tank 21 to the outside. The draining assembly includes a draining pump 33 that is positioned on the draining pipe 31.

The water-supplying assembly includes a water-supplying pipe 41 that guides water from an external water source into the outer tank 21. The water-supplying assembly includes a detergent accommodation unit 43 that is positioned on the water-supplying pipe 41. The detergent accommodation unit 43 accommodates a detergent or the like. The detergent or the like dissolves in water that flows along the water supply pipe 41.

With reference to FIGS. 3 and 4, the front cover 12*a* includes a backward bent portion 12*a*1 that results from bending the front surface in such a manner that an upper portion of the front surface extends in the backward direction. The backward bent portion 12*a*1 is formed to extend in a leftward-rightward direction.

The front cover 12*a* includes the upward bent portion 12*a*2 that results from bending the backward bent portion 12*a*1 in such a manner that a rear end portion of the backward bent portion 12*a*1 extends in the upward direction. The upward bent portion 12*a*2 is formed where the hanger 28 is positioned. The upward bent portion 12*a*2 is formed on both end portions of the backward bent portion 12*a*1. The upward bent portion 12*a*2 is not formed a rear end of the center portion of the backward bent portion 12*a*1. The center portion of the backward bent portion 12*a*1 is inserted into a front opening in the front member 100. The rear end of the center portion of the backward bent portion 12*a*1 is brought into contact with a rear surface portion 120 of the front member 100.

The side covers 12*b* in a pair include sideward bent portions 12*b*1, respectively, each of which results from bending the each side cover 12*b* in a direction in which upper end portions of both flank surfaces of the each side cover 12*b* face each other. A side cover 12*b* in the first direction and a side cover 12*b* in the second direction constitute the pair of side covers 12*b*. The side cover 12*b* in the first direction includes the sideward bent portion 12*b*1 that results from bending the side cover 12*b* in the first direction in such a manner that an upper end portion of the side cover 12*b* in the first direction extends in the second direction. The side cover 12*b* in the second direction includes the sideward bent portion 12*b*1 that results from bending the side cover 12*b* in the second direction in such a manner that an upper end portion of the side cover 12*b* in the second direction extends in the first direction. The sideward bent portion 12*b*1 is formed to extend in a forward-backward direction.

Figure 9:
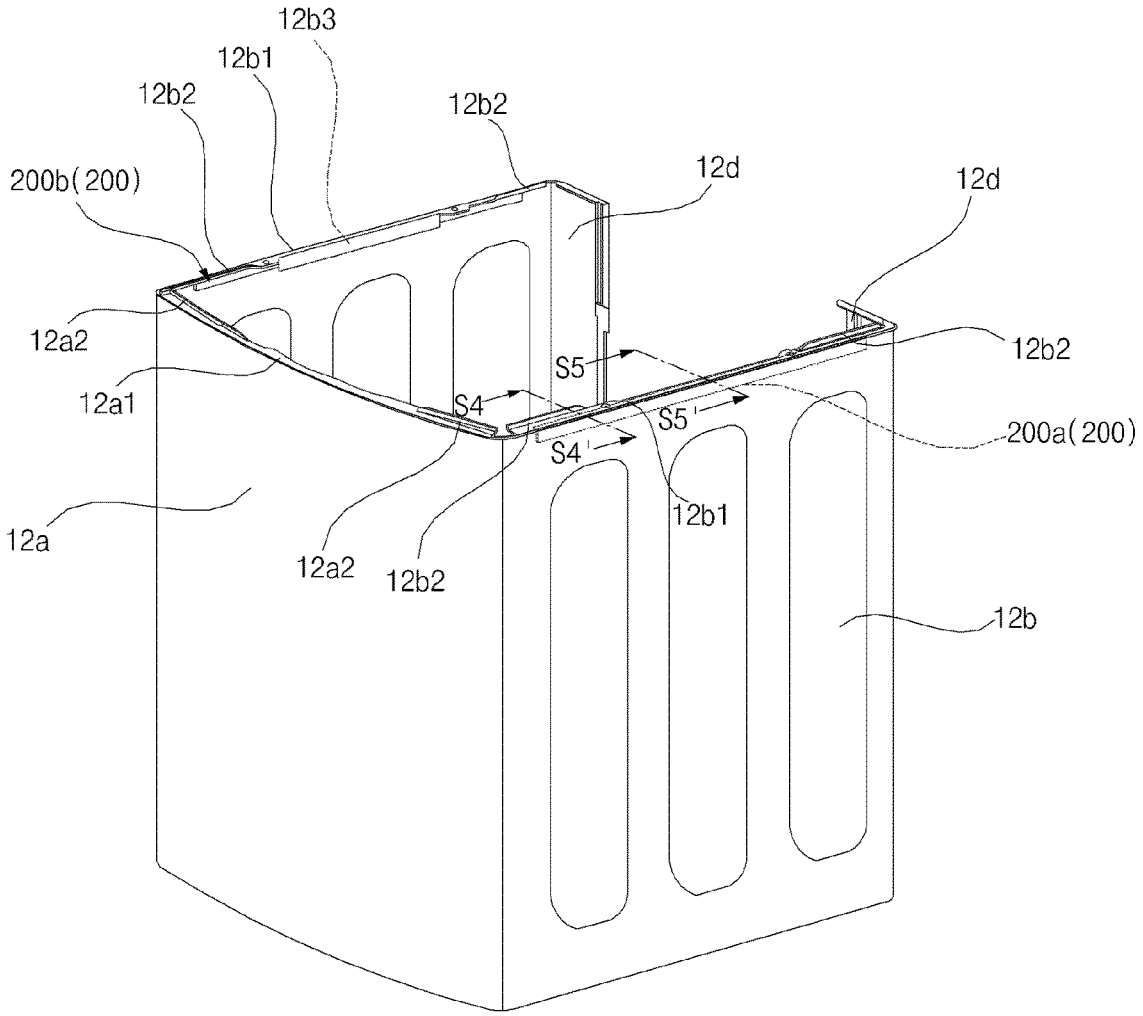
FIG. 9 is a perspective diagram illustrating the cabinet in FIG. 1 and a lateral member that is connected to the cabinet.
Figure 10:
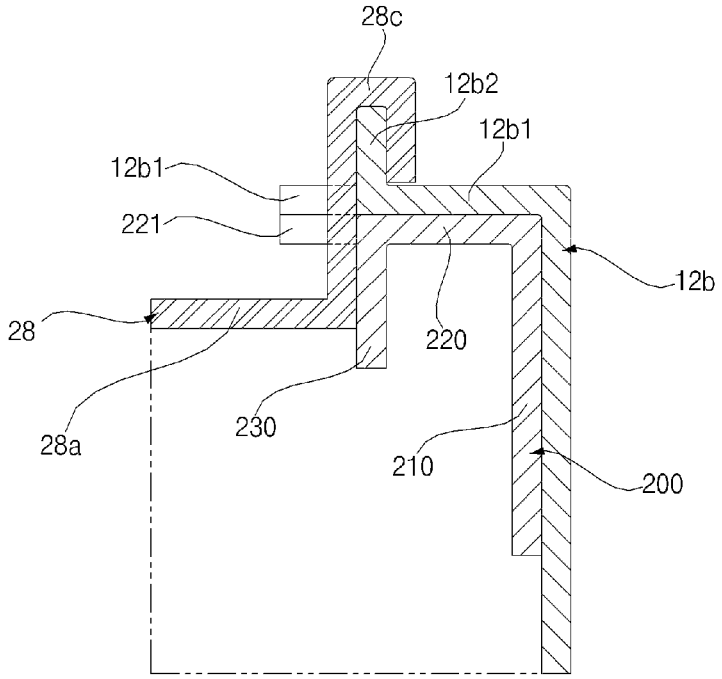
FIG. 10 is a cross-sectional diagram illustrating a side cover and the lateral member, taken along line S4-S4' on FIG. 9.
Figure 11:
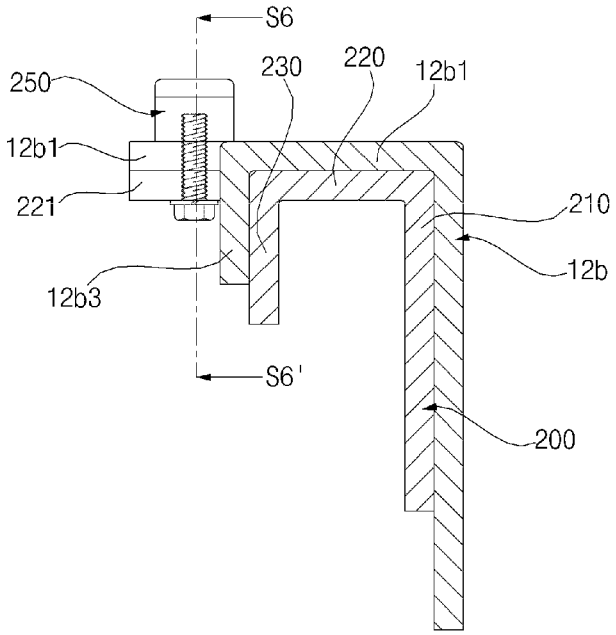
FIG. 11 is a cross-sectional diagram illustrating the side cover and the lateral member, taken along line S5-S5' on FIG. 9.

With reference to FIG. 9, the side cover 12*b* includes the upward bent portion 12*b*2 that results from bending the sideward bent portion 12*b*1 in such a manner that the endmost portion of the sideward bent portion 12*b*1 extends upward. The upward bent portion 12*b*2 is formed where the hanger 28 is positioned. The upward bent portion 12*b*2 is formed on a front end portion of the sideward bent portion 12*b*1. The upward bent portion 12*b*2 is formed on a rear end portion of the sideward bent portion 12*b*1. The upward bent portion 12*b*2 is not formed on the center portion of the sideward bent portion 12*b*1. A downward bent portion 12*b*3 is formed on the center portion of the sideward bent portion 12*b*1. The downward bent portion 12*b*3 is formed as a result of bending the sideward bent portion 12*b*1 in such a manner that the endmost portion of the sideward bent portion 12*b*1 extends downward.

Specifically, the side cover 12*b* in the first direction includes the upward bent portion 12*b*2 that extends upward from the second-direction end of the sideward bent portion 12*b*1. The side cover 12*b* in the first direction includes the downward bent portion 12*b*3 that extends downward from the second-direction end of the sideward bent portion 12*b*1. The side cover 12*b* in the second direction includes the upward bent portion 12*b*2 that extends upward from the first-direction end of the sideward bent portion 12*b*1. The side cover 12*b* in the second direction includes the downward bent portion 12*b*3 that extends downward from the first-direction end of the sideward bent portion 12*b*1.

With reference to FIGS. 1 and 4, the top cover 11 includes a top-cover upper-surface portion (not illustrated) that has the insertion opening, a top-cover front-portion 11*a* that is connected to the front cover 12*a*, a top-cover lateral portion (not illustrated) that is connected to each of the side covers 12*b* in a pair, and a top-cover rear surface portion (not illustrated) that is connected to the back cover 13.

The cover 11 includes a backward protrusion portion 11*b* that protrudes backward from a front lower end of the top cover 11. The backward protrusion portion 11*b* is inserted into a gap g. A lower-side surface of the backward protrusion portion 11*b* is brought into contact with an upper-side surface of the backward bent portion 12*a*1. The upper-side surface of the backward bent portion 12*a*1 is brought into contact with a lower-side surface of a gap formation portion 115. The backward protrusion portion 11*b* is positioned to pass through the rear surface portion 120 in the forward-backward direction.

The cover 11 includes a sub-protrusion-portion 11*c* that protrudes backward from the front lower end of the top cover 11. A protrusion length of the sub-protrusion-portion 11*c* is shorter than a protrusion length of the backward protrusion portion 11*b*. The sub-protrusion-portion 11*c* and the backward protrusion portion 11*b* are formed to be connected with each other in the leftward-rightward direction. The sub-protrusion-portion 11*c* is inserted between a fixation portion 111 and a sub-member 150. Due to an elastic force of the sub-member 150, the sub-protrusion-portion 11*c* is interposed between the fixation portion 111 and the sub-member 150.

With reference to FIGS. 4 to 8, the front member 100 is connected to the backward bent portion 12*a*1. The front member 100 extends in the leftward-rightward direction along the backward bent portion 12*a*1. The front member 100 is formed in such a manner that a cross section taken along the forward-backward direction, of the front member 100 takes the shape of the Korean alphabet "ㄷ" with an opening in the forward direction. The front member 100 is fixed to an upper end portion of the front cover 12*a*. The front member 100 is positioned inward from the upper end portion of the front cover 12*a*. The front member 100 is positioned between the hangers 28 on both the front sides.

The front member 100 includes an upper surface portion 110 that is fixed to the upper side of the backward bent portion 12*a*1. At least one portion of a lower-side surface of the upper surface portion 110 is brought into contact with the upper-side surface of the backward bent portion 12*a*1. The upper surface portion 110 extends in the leftward-rightward direction. The lower-side surface of the upper surface portion 110 has two or more different heights.

The upper surface portion 110 includes the gap formation portion 115 that is positioned by a distance upward from the upper-side surface of the backward bent portion 12*a*1, and thus forms a gap, along with the upper-side surface of the backward bent portion 12*a*1. The lower-side surface of the gap formation portion 115 is brought into contact with the backward protrusion portion 11 of the top cover 11. Multiple gap formation portions 115 are arranged at distances from each other in the leftward-rightward direction. Multiple backward protrusion portions 11*b* are correspondingly inserted into gaps (g), respectively.

The upper surface portion 110 includes the fixation portion 111 that is connected to the upper-side surface of the backward bent portion 12*a*1. A lower-side surface of the fixation portion 111 is positioned at a lower height than the lower-side surface of the gap formation portion 115. The upper-side surface of the backward bent portion 12*a*1 constitutes a horizontal plane. In a state where the fixation portion 111 is brought into contact with the upper-side surface of the backward bent portion 12*a*1, a lower-side surface of the gap formation portion 115 forms a gap along with the upper-side surface of the backward bent portion 12*a*1. A fixation hole 112 is formed that passes through the fixation portion 111 in the upward or downward direction. A fastening member 160, such as a screw, passes through the fixation hole 112 to connect the fixation portion 111 and the backward bent portion 12*a*1 to each other.

The front member 100 includes the rear surface portion 120 that extend downward from a rear end of the upper surface portion 110. The rear surface portion 120 extends in the leftward-rightward direction. An upper end of the rear surface portion 120 is supported by the rear end of the upper surface portion 110. A through-hole through which the backward protrusion portion 11*b* passes is formed in the rear surface portion 120. Multiple through-holes are formed and multiple backward protrusion portions 11*b* are correspondingly inserted in the multiple through-holes, respectively.

The front member 100 includes a lower surface portion 130 that extends forward from a lower end of the rear surface portion 120. The lower surface portion 130 extends in the leftward-rightward direction. A lower end of the lower surface portion 130 is supported by the lower end of the rear surface portion 120. A front end of the lower surface portion 130 is brought into contact with an inside surface of the front cover 12*a*. By doing so, the strength of a front upper end portion of the cabinet 12 is further increased.

The front member 100 includes hanger connection portions 140 that are arranged on both end portions of the front member 100, respectively. The hanger connection portion 140 is connected to the hanger 28. Hanger connection portions 140*a* and 140*b* in a pair are connected to the hangers 28 in a pair, respectively.

The hanger connection portion 140 includes an extension portion 143 that extends sideways from the lower surface portion 130. A first extension portion 143 is provided that extends in the first direction from the first-direction endmost portion of the lower surface portion 130. A second extension portion 143 is provided that extends in the second direction from the second-direction endmost portion of the lower surface portion 130. The extension portion 143 extends obliquely upward from the lower surface portion 130.

The hanger connection portion 140 includes a hanger hook portion 142 that is positioned on the endmost portion of the extension portion 143. The hanger hook portion 142 is hooked to the support plate 28*a*. A first hanger hook portion 142 is provided that extends from a first-direction endmost portion of the first extension portion 143. A second hanger hook portion 142 is provided that extends from a second-direction endmost portion of the second extension portion 143. For formation, a groove is recessed upward from the bottom of the hanger hook portion 142. An upward-protruding portion is formed on an edge of the support plate 28*a*, and the upward-protruding portion of the support plate 28*a* is inserted into the groove in the hanger hook portion 142. The groove in the hanger hook portion 142 extends in the forward-backward direction.

The hanger connection portion 140 includes a support portion 141 that extends sideways from the hanger hook portion 142. The support portion 141 is brought into contact with an upper-side surface of the support plate 28*a*. The support portion 141 is formed as a plate that has the thickness in the upward and downward direction. A first support portion 141 is provided that extends in the first direction from the first hanger hook portion 142. A second support portion 141 is provided that extends in the second direction from the second hanger hook portion 142.

Figure 5:
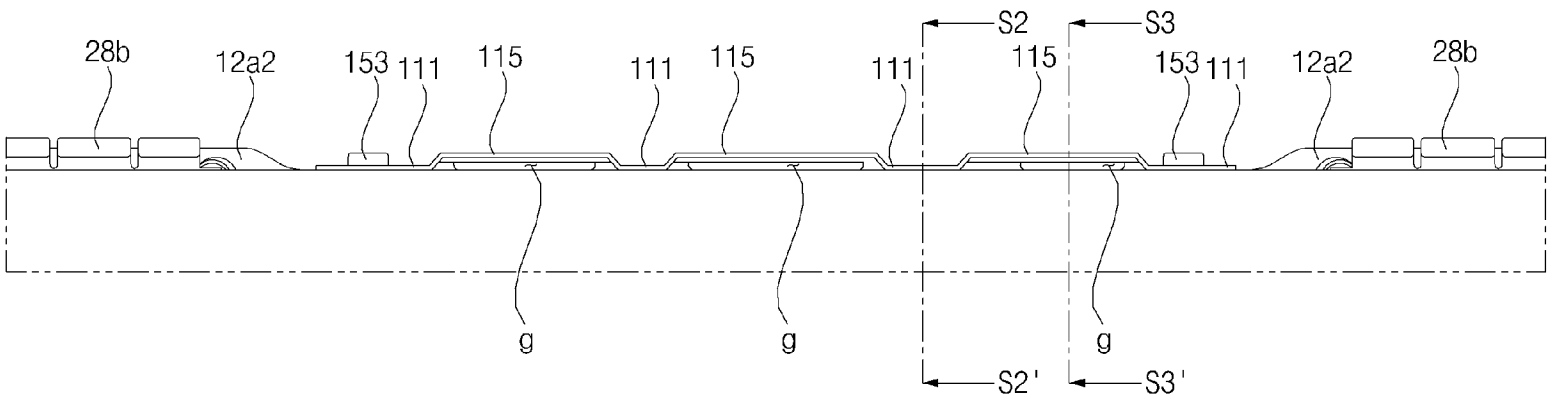
FIG. 5 is an elevation diagram illustrating the front upper-side portion of the cabinet and the front member, when viewed from front.
Figure 6:
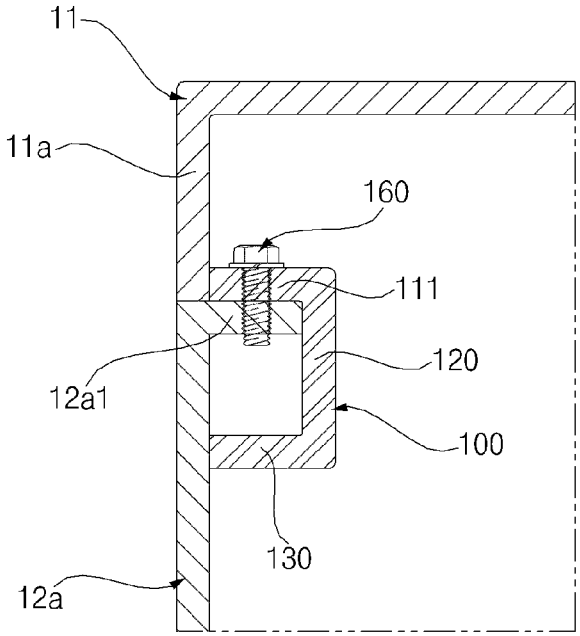
FIG. 6 is a vertical cross-sectional diagram illustrating the front cover, the front member, and the top cover, taken along line S2-S2' on FIGS. 4 and 5.
Figure 7:
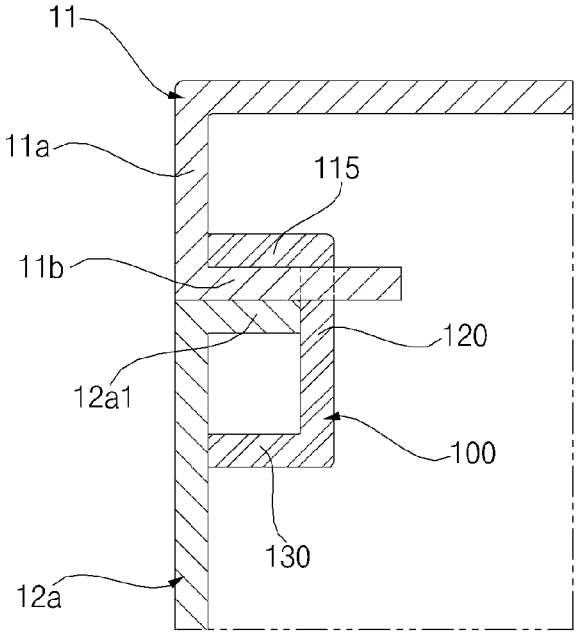
FIG. 7 is a vertical cross-sectional diagram illustrating the front cover, and the front member, and the top cover, taken along line S3-S3' on FIGS. 4 and 5.
Figure 8:
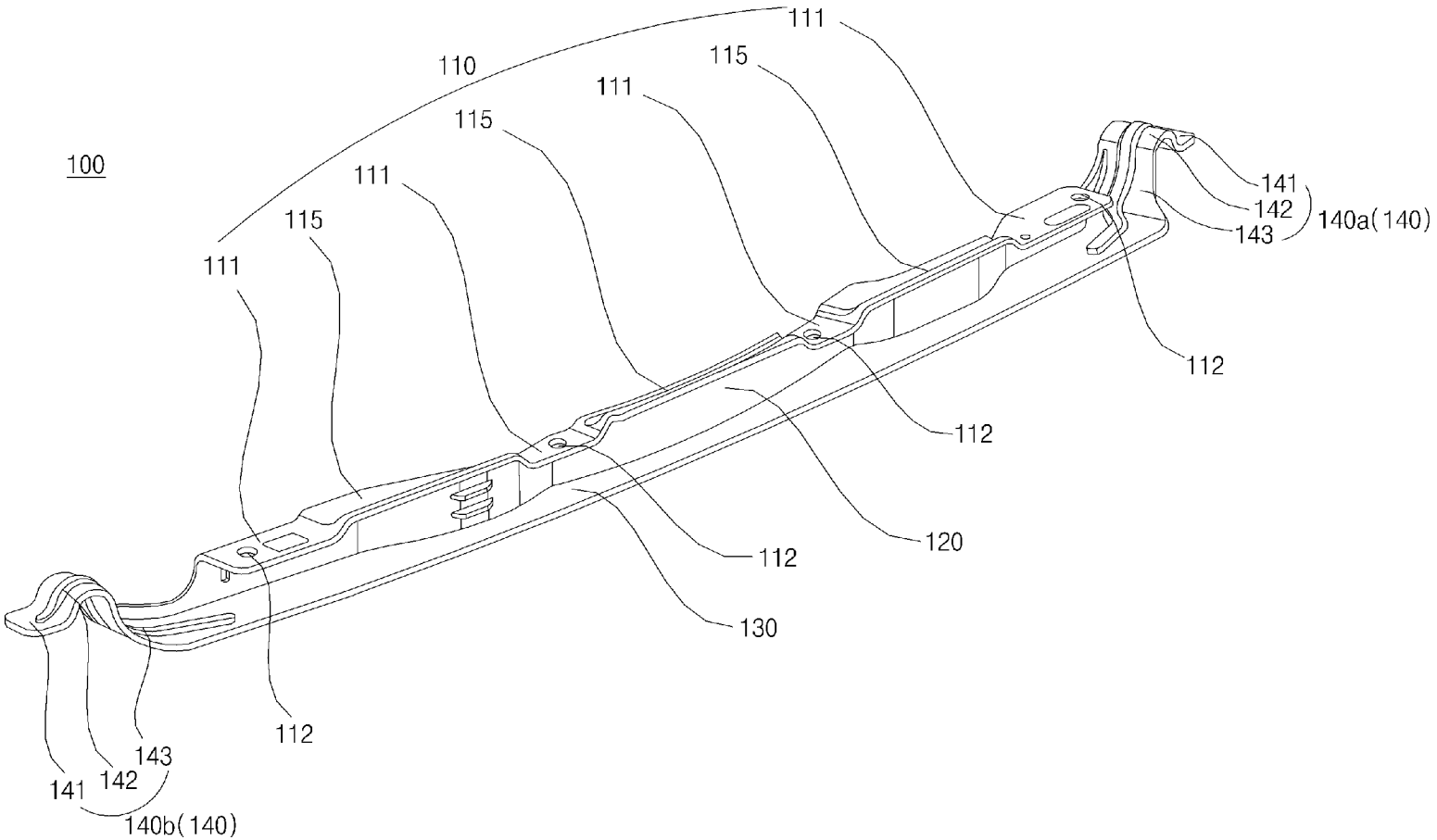
FIG. 8 is a perspective diagram illustrating the front member in FIG. 4.

With reference to FIGS. 4 and 5, the apparatus 1 for treating laundry includes the sub-member 150. The sub-member 150 is fixed to the front member 100.

The sub-member 150 is fastened to the rear surface portion 120. The sub-member 150 includes a sub-fixation-portion 151 that is fixed to the rear surface portion 120. The sub-fixation-portion 151 is formed as a plate that has the thickness in the forward-backward direction. A fastening hole is formed that passes through the sub-fixation-portion 151 in the forward-backward direction.

The sub-member 150 has a surface that is positioned on the upper side of the fixation portion 111. The sub-member 150 includes a sub-securely-holding-portion 153 that has a surface facing an upper-side surface of the fixation portion 111. A rear end of the sub-securely-holding-portion 153 is supported by an upper end of the sub-fixation-portion 151. The sub-protrusion-portion 11*c* of the top cover 11 is inserted between the sub-fixation-portion 151 and the fixation portion 111. With an elastic restoring force, the sub-member 150 pushes down the sub-protrusion-portion 11*c*.

With reference to FIGS. 9 to 15, a lateral member 200 is positioned on at least one of the upper end portions of the side covers 12*b* in a pair. According to the present embodiment, lateral members 200*a* and 200*b* in a pair are provided that extend in the forward-backward direction along the sideward bent portion 12*b*1. As a reference, the lateral member 200*a* in the first direction of the lateral members 200*a* and 200*b* in the first and second directions will be described below.

The lateral member 200 is fixed to the sideward bent portion 12*b*1. The lateral member 200 extends in the forward-backward direction along the sideward bent portion 12*b*1. The lateral member 200 is formed in such a manner that a cross section in the forward-backward direction, of the lateral member 200 takes the shape of the Korean alphabet "ㄷ" with an opening in the downward direction. The lateral member 200 is fixed to the upper end portion of the side cover 12*b*. The lateral member 200 is positioned inward from the upper end portion of the side cover 12*b*. The side cover 12*b* is bent in such a manner that the upper end portion of the side cover 12*b* extends sideways to cover an external surface of the lateral member 200.

The lateral member 200 includes a first part 210 that is brought into contact with a second-direction inside surface of the side cover 12*b* in the first direction. The first part 210 extends in the forward-backward direction. The first part 210 is formed as a plate that has the thickness in the leftward-rightward direction.

The lateral member 200 includes a second part 220 that extends sideways from the first part 210. The second part 220 extends in the second direction from an upper end portion of the first part 210. The second part 220 is brought into contact with a lower-side surface of the sideward bent portion 12*b*1. The second part 220 extends in the forward-backward direction. The second part 220 is formed as a plate that has the thickness in the upward and downward direction.

The lateral member 200 includes a lateral protrusion portion 221 that protrudes in the second direction from the second part 220. The lateral protrusion portion 221 protrudes in the overall shape of a semicircle when viewed from above. A connection hole 221*a* is formed in a position on the second part 220, which corresponds to the lateral protrusion portion 221. The connection hole 221*a* passes through the second part 220 in the upward and downward direction. A fastening member 260, such as a screw, passes through the connection hole 221 to connect the second part 220 and the sideward bent portion 12*b*1 to each other. The fastening member 260 fixes a holder 250 to the second part 220. The fastening member 260 fastens the lateral member 200, the side cover 12*b*, and the holder 250 to each other in a triple-fastening manner.

The lateral member 200 includes a third part 230 that extends sideways from the second 220. The third part 230 extends downward from the second-direction endmost portion of the second part 220. The third part 230 is brought into contact with a first-direction inside surface of the downward bent portion 12*b*3. The third part 230 extends in the forward-backward direction. The third part 230 does not have a portion thereof that corresponds to a position of the lateral protrusion portion 221. A groove 230*a* is formed in the third part 230 in such a manner that the groove 230*a* is positioned below the lateral protrusion portion 221. The third part 230 is formed as a plate that has the thickness in the leftward-rightward direction.

The apparatus 1 for treating laundry includes the holder 250 that is fixed to at least one of the sideward bent portion 12*b*1 and the second part 220. According to the present embodiment, the holder 250 is connected to the sideward bent portion 12*b*1 and the second part 220 in a triple fastening manner. The holder 250 protrudes upward and thus the top cover is caused to be hooked to the holder 250. The holder 250 protrudes upward from the upper end of the side cover 12*b*. The holders 250 in a pair are arranged on the upper ends of the side covers 12*b* in a pair, respectively. As a reference, the holder 250 in the first direction of the holders 250 in the first and second directions will be described below.

The holder 250 includes a first holder 250*a* that is positioned on the front side and a second holder 250*b* that is positioned on the rear side. Holder grooves 11*h* into each of which the holder 250 is inserted are formed in the top cover 11. The holder grooves 11*h* are formed in a lower surface of the top cover 11. The holder grooves 11*h* are formed in lower-side portions, respectively, of both edge portions of the top cover 11. A first holder groove (11*h*1) is formed in a position on the top cover 11, which corresponds to the first holder 250*a*, and a second holder groove 11*h*2 is formed in a position on the top cover 11, which corresponds to the second holder 250*b*.

The first holder 250*a* is formed to take the shape of a hook that protrudes forward. The first holder 250*a* includes a support portion (not illustrated) that is connected to the side cover 12*b*, and a protrusion portion (not illustrated) that protrudes forward from an upper end of the support portion. The first holder groove 11*h*1 has a space into which an upper-side surface of the protrusion portion of the first holder 250*a* is inserted, and has a recess space that is recessed in the front direction from an upper portion of a left wall surface of the space. The protrusion portion of the first holder 250*a* is inserted into the recess space in the first holder groove 11*h*1, which is recessed in the front direction, and thus the top cover 11 is fixed to the side cover 12*b*.

The second holder 250*b* is formed to protrude upward. The second holder 250*b* may be formed in the shape of a cone. The second holder 250*b* may be formed to be tapered in thickness away from the bottom to the top. Only in a state where the protrusion portion of the first holder 250*a* is inserted into the recess space in the first holder groove 11*h*1, which is recessed in the front direction, the second holder 250*b* and the second groove 11*h*2 are configured to be engaged with each other. The second holder 250*b* and the second holder groove 11*h*2 serve to set a position of the top cover 11 with respect to the side cover 12*b*.

Figure 12A:
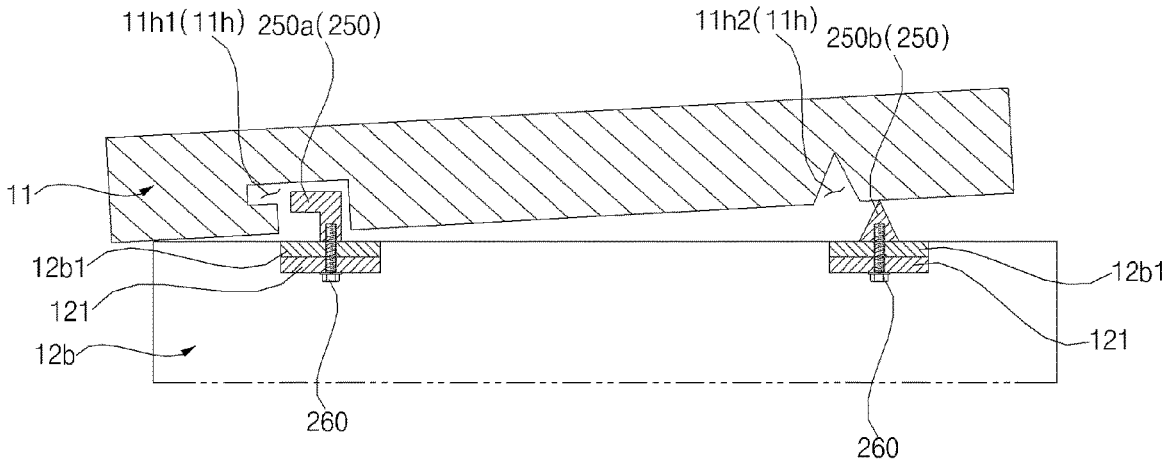
FIG. 12A is a vertical cross-sectional diagram illustrating the side cover, the lateral member, and a holder, taken along ling S6-S6' on FIG. 11, in a state where the top cover is not connected to the side cover and a first holder is inserted into a first holder groove for a connection process.
Figure 12B:
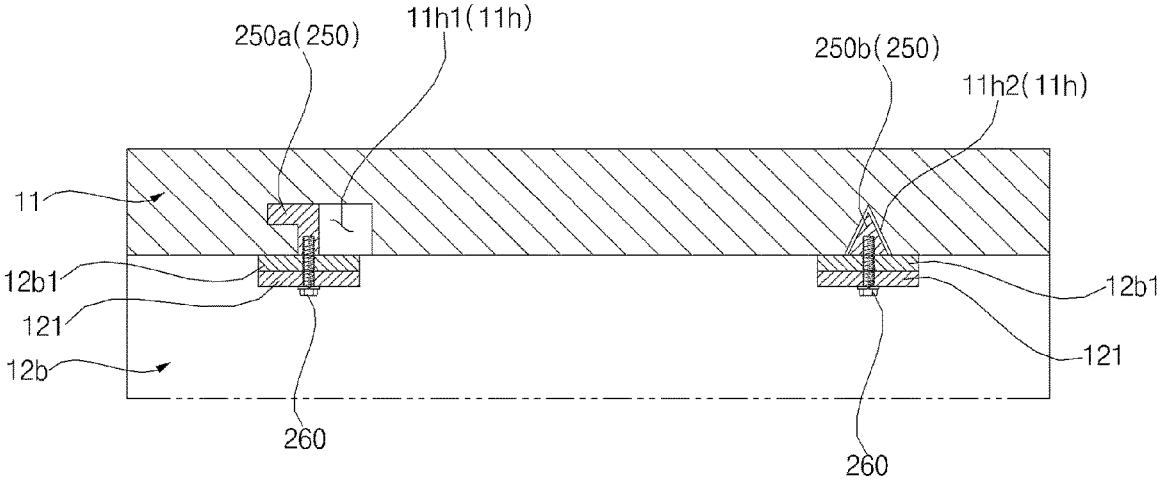
FIG. 12B is a cross-sectional diagram illustrating the top cover in a state where the top cover is completely connected to the side cover.
Figure 13:
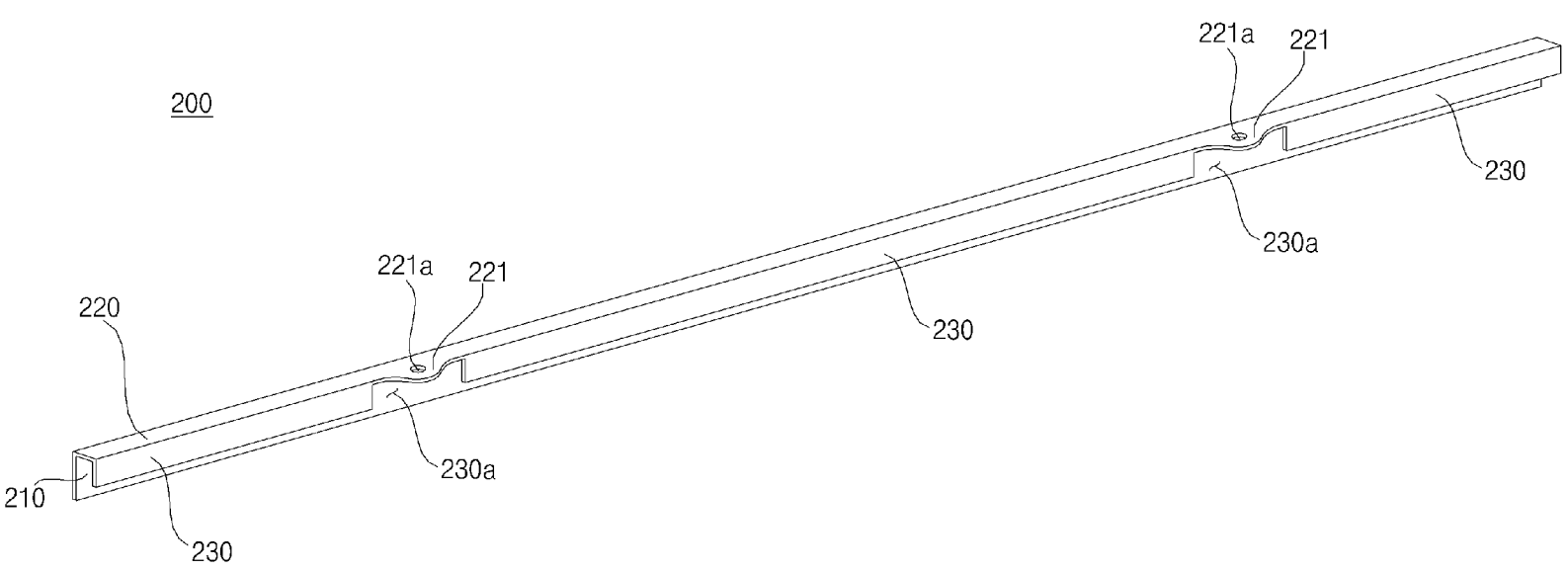
FIG. 13 is a perspective diagram illustrating the lateral member in FIG. 9.
Figure 14:
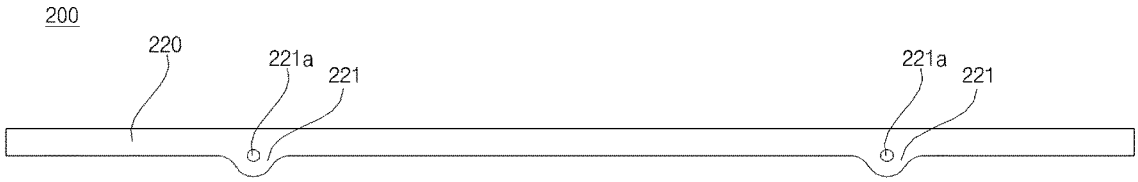
FIG. 14 is an elevation diagram illustrating the lateral member in FIG. 13, when viewed from above.
Figure 15:
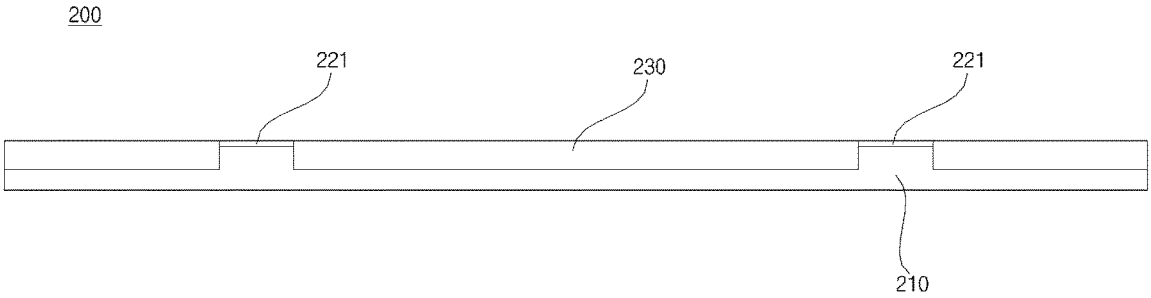
FIG. 15 is an elevation diagram illustrating the lateral member in FIG. 13, when viewed from the side.

With reference to FIG. 12*a*, the first holder 250*a* is inserted into the space in the first holder groove 11*h*1 in order to connect the top cover 11 to the side cover 12*b*. At this time, the second holder 250*b* is not inserted into the second holder groove 11*h*2, and therefore the top cover 11 is in a state of being inclined forward with respect to the side cover 12*b*. In this state, the top cover 11 is slid backward. With reference to FIG. 12, the protrusion portion of the first holder 250*a* is inserted into the recess space in the first holder groove 11*h*1, which is recessed in the front direction, the second holder 250*b* is inserted into the second holder groove 11*h*2, and thus the cover 11 is fixed to the side cover 12*b*.

What is claimed is:

1. A laundry treating apparatus, comprising:

a front cover comprising an upper end portion and a backward bent portion that is bent from the upper end portion and that extends in a backward direction from the upper end portion;

side covers;

a back cover;

an outer tank that is located in a space defined by the front cover, the side covers, and the back cover, the outer tank being configured to receive water;

an inner tank located inside of the outer tank and configured to receive laundry, the inner tank being configured to rotate with respect to the outer tank;

a motor configured to rotate the inner tank with respect to the outer tank;

a front coupling member that is configured to couple to the backward bent portion of the front cover and that extends toward the side covers along the backward bent portion;

a top cover configured to couple to the upper end portion of the front cover, upper ends of the side covers, and an upper end of the back cover, the top cover defining an insertion hole configured to receive laundry;

a hanger located at a corner between the front cover and one of the side covers and coupled to the upper end portion of the front cover; and a tension member that has a first end connected to the hanger and a second end connected to the outer tank, the tension member being configured to suspend the outer tank, wherein the front coupling member includes a hanger connection portion located at a side end portion of the front coupling member and configured to couple to the hanger.

2. The laundry treating apparatus according to claim 1, wherein the front coupling member includes a gap formation portion that is spaced apart from an upper surface of the backward bent portion to define a gap between the front coupling member and the upper surface of the backward bent portion, and wherein the top cover includes a backward protrusion portion that protrudes backward from a front lower end of the top cover and that is configured to insert into the gap between the front coupling member and the upper surface of the backward bent portion.

3. The laundry treating apparatus according to claim 2, wherein the front coupling member further includes a fixation portion that is configured to couple to the upper surface of the backward bent portion of the front cover.

4. The laundry treating apparatus according to claim 3, further comprising a sub-coupling member configured to couple to the front coupling member and to face an upper side of the fixation portion of the front coupling member, wherein the top cover further includes a sub-protrusion-portion that protrudes backward from the front lower end of the top cover and that is configured to insert between the fixation portion and the sub-coupling member.

5. The laundry treating apparatus according to claim 2, wherein the front coupling member further includes:

an upper surface portion that includes the gap formation portion; and a rear surface portion that extends downward from a rear end of the upper surface portion and that defines a through-hole configured to receive the backward protrusion portion of the top cover.

6. The laundry treating apparatus according to claim 1, wherein the front coupling member includes:

an upper surface portion configured to couple to an upper side of the backward bent portion of the front cover;

a rear surface portion that extends downward from a rear end of the upper surface portion of the front coupling member; and a lower surface portion that extends forward from a lower end of the rear surface portion of the front coupling member.

7. The laundry treating apparatus according to claim 6, wherein a front end of the lower surface portion is configured to contact an inside surface of the front cover.

8. The laundry treating apparatus according to claim 1, wherein the hanger includes a support plate that extends in a horizontal direction, wherein the front coupling member further includes:

an upper surface portion configured to couple to an upper side of the backward bent portion of the front cover, a rear surface portion that extends downward from a rear end of the upper surface portion of the front coupling member, and a lower surface portion that extends forward from a lower end of the rear surface portion of the front coupling member, and wherein the hanger connection portion includes:

an extension portion that extends from the lower surface portion of the front coupling member toward one of the side covers, and a hanger hook portion located at an end portion of the extension portion and configured to couple to the support plate of the hanger.

9. The laundry treating apparatus according to claim 1, wherein the side covers comprise a pair of side covers that face toward each other, wherein each side cover comprises a sideward bent portion that is bent from an upper end of one of the pair of side covers toward the other of the pair of side covers, and wherein the laundry treating apparatus further comprises lateral members that are each configured to couple to one of the pair of side covers and that extend toward the back cover along the sideward bent portion.

10. The laundry treating apparatus according to claim 9, wherein each lateral member includes:

a first part configured to contact an inside surface of one of the pair of side covers; and a second part that is bent from the first part and that is configured to contact a lower-side surface of the sideward bent portion.

11. The laundry treating apparatus according to claim 10, wherein each side cover further includes a downward bent portion that extends downward from an end portion of the sideward bent portion.

12. The laundry treating apparatus according to claim 11, wherein each lateral member further includes a third part that extends downward from the second part and that is configured to contact an inside surface of the downward bent portion of one of the pair of side covers.

13. The laundry treating apparatus according to claim 10, further comprising a holder that is configured to couple to at least one of the sideward bent portion of the pair of side covers or the second part of the lateral members, that protrudes upward from the pair of side covers, and that is configured to couple to the top cover.

14. The laundry treating apparatus according to claim 9, wherein the front cover and the pair of side covers are bent plates.

15. A laundry treating apparatus, comprising:

a front cover;

side covers, each side cover including a sideward bent portion that is bent from an upper end portion of a first side cover of the side covers and that extends in a direction toward a second side cover of the side covers that faces toward the first side cover;

a back cover;

an outer tank that is located in a space defined by the front cover, the side covers, and the back cover, and that is configured to receive water;

an inner tank located inside of the outer tank and configured to receive laundry, the inner tank being configured to rotate with respect to the outer tank;

a motor configured to rotate the inner tank with respect to the outer tank;

lateral members that each extend toward the back cover along the sideward bent portion; and a top cover that is configured to couple to an upper end of the front cover, upper ends of the side covers, and an upper end of the back cover, the top cover defining an insertion hole configured to receive laundry, wherein each lateral member includes:

a first part configured to contact an inside surface of one of the side covers, and a second part configured to contact a lower-side surface of the sideward bent portion.

16. The laundry treating apparatus according to claim 15, wherein each side cover further includes a downward bent portion that extends downward from an end portion of the sideward bent portion, and wherein each lateral member further includes a third part that extends downward from the second part and that is configured to contact an inside surface of the downward bent portion.

17. The laundry treating apparatus according to claim 15, further comprising a holder that is configured to couple to at least one of the sideward bent portion or the second part, that protrudes upward from the side covers, and that is configured to couple to the top cover.

* * * * *